US005621947A

United States Patent [19]

Fitz et al.

[11] Patent Number: 5,621,947

[45] Date of Patent: Apr. 22, 1997

[54] HINGE FOR AN ARTICLE OF FURNITURE WITH A FRAME

[75] Inventors: Helmut Fitz, Lustenau; Erich Röck, Höchst, both of Austria

[73] Assignee: Julius Blum Gesellschaft m.g.H., Höchst, Austria

[21] Appl. No.: 438,972

[22] Filed: May 11, 1995

[51] Int. Cl.[6] ..... E05D 7/04; E05D 7/06

[52] U.S. Cl. ..... 16/249; 16/240; 16/388; 16/DIG. 43

[58] Field of Search ..... 16/236, 239, 240, 16/243, 249, DIG. 43, 388

[56] References Cited

U.S. PATENT DOCUMENTS

| | | | |
|---|---|---|---|
| 4,312,098 | 1/1982 | Sundermeier | 16/240 |
| 4,368,558 | 1/1983 | Grass | 16/249 |
| 4,506,405 | 3/1985 | Lautenschlager | 16/DIG. 43 |
| 4,554,706 | 11/1985 | Röck et al. | 16/237 |
| 4,604,769 | 8/1986 | Röck et al. | 16/238 |
| 5,052,077 | 10/1991 | Lautenschlager et al. | 16/240 |
| 5,193,247 | 3/1993 | Placer et al. | 16/249 |
| 5,375,297 | 12/1994 | Lauterschlager et al. | 16/249 |
| 5,379,487 | 1/1995 | Bowers | 16/249 |

FOREIGN PATENT DOCUMENTS

| | | | |
|---|---|---|---|
| 2648860 | 5/1978 | Germany | 16/DIG. 43 |

*Primary Examiner*—M. Rachuba
*Assistant Examiner*—Donald M. Gurley
*Attorney, Agent, or Firm*—Wenderoth, Lind & Ponack

[57] ABSTRACT

A hinge for mounting a door on a frame of an article of furniture includes a mounting plate mountable to the frame, a hinge arm mounted on the mounting plate, and a hinge case mountable to the door end connected to the hinge arm by at least one hinge axle. The mounting plate is fastenable to the frame by at least one fastening screw. The mounting plate is provided with a key hole or a T-shaped hole having a broad first part and a narrow second part. An adjustment screw is mounted in a female thread of the hinge arm and has a head part and a neck part, the neck part being of smaller diameter than a threaded part of the screw. The width of the broad first part of the hole is broader than the diameter of the head part of the adjustment screw and the width of the narrow second part of the hole is less than the diameter of the head part and of the threaded part. The neck part of the adjustment screw is held in the narrow second part of the hole, and the head part abuts a rear side of the mounting plate.

13 Claims, 5 Drawing Sheets

HINGE FOR AN ARTICLE OF FURNITURE WITH A FRAME

BACKGROUND OF THE INVENTION

The invention relates to a hinge for an article or pieces of furniture with a frame and for mounting a door to the frame, and including a mounting plate mountable to the frame, a hinge arm mounted on the mounting plate, and a hinge case mountable to the door and, being connected to the hinge arm by at least one hinge axle, and whereby the mounting plate is fastenable to the frame by at least one fastening screw.

In modern furniture construction so-called door frames are used. Such frames carry hinges for the door, and the actual side walls of the furniture body are made of a weaker material. This has the advantage that the total cost of the piece of furniture can be reduced because the side walls may be extremely thin and can be made of material of better quality and more attractive outward appearance without increasing the cost of the piece of furniture when compared with conventionally manufactured pieces of furniture.

This new type of furniture resulted in demand for specially constructed hinges which can be mounted on the frame of the piece of furniture. A hinge with a hinge arm and a mounting plate which is fastenable to such a frame is shown in U.S. Pat. No. 4,604,769. U.S. Pat. No. 4,554,706 shows a hinge mountable to such a frame whereby the mounting plate for the hinge arm embraces the frame in a U-shaped manner. The mounting plate has two flanges, one flange being rigid and the other flange having a resilient member. By means of the resilient member, the mounting plate is mountable on frames with varying thicknesses. The pressure exerted by the resilient flange is not sufficient for anchoring the mounting plate on the frame. Therefore, a fastening screw is provided for fastening the mounting plate to the frame.

SUMMARY OF THE INVENTION

It is the object of the invention to provide an improved hinge of the above mentioned type, whereby the position of the door can be adjusted in the plane of the closed door in a horizontal direction perpendicular to the frame member on which the door is mounted.

According to the invention this is achieved by providing the mounting plate with a key hole or a hole having a T-shape, the hole having a broad first part and a narrow second part, and an adjustment screw mounted in a female thread of a hinge arm, the adjustment screw having a head part and a neck part. The neck part is of smaller diameter than a threaded part of the screw. The width of the broad first part of the hole is broader than the diameter of the head part of the adjustment screw, and the width of the narrow second part of the hole is less than the diameter of the head part and of the threaded part. Thus, the neck part of the adjustment screw is held in the narrow second part of the hole and the head abuts the rear side of the mounting plate.

DETAILED DESCRIPTION OF THE INVENTION

Figure 1:
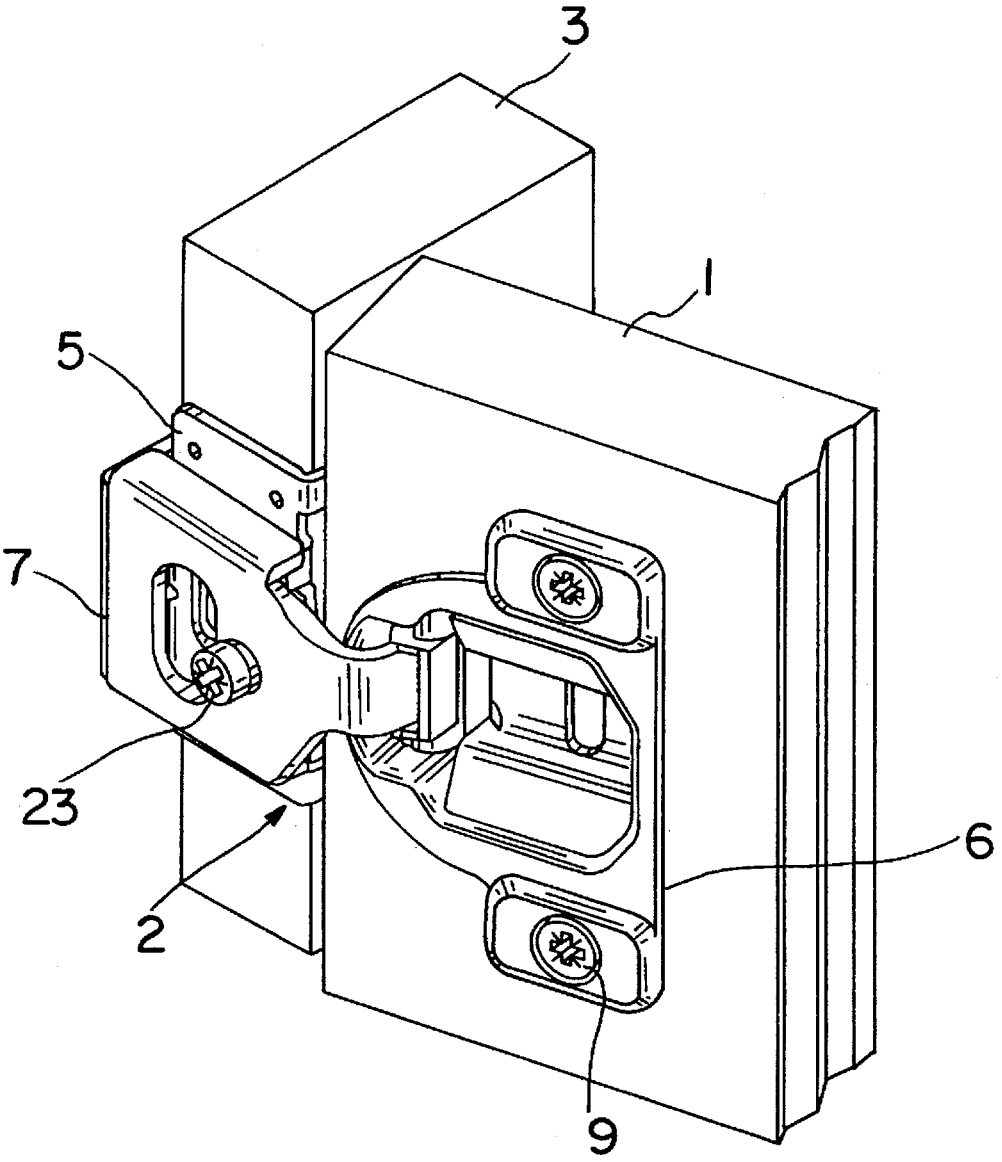
FIG. 1 is a diagrammatic perspective view of a hinge, also showing parts of a frame and of a door.
Figure 2:
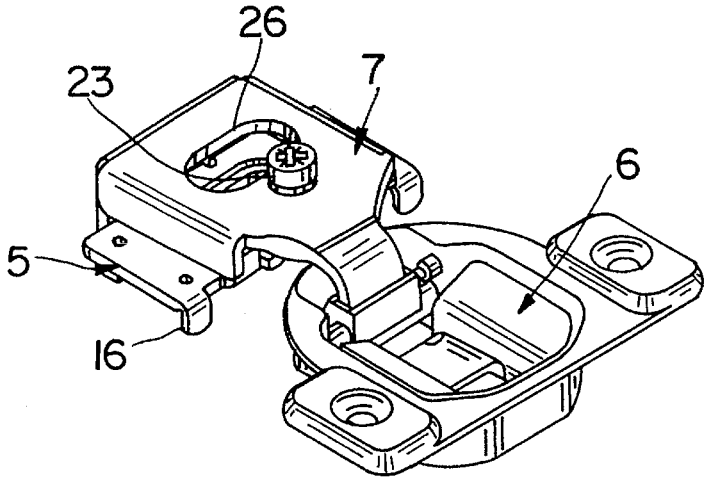
FIG. 2 is a diagrammatic perspective view of the hinge.
Figure 3:
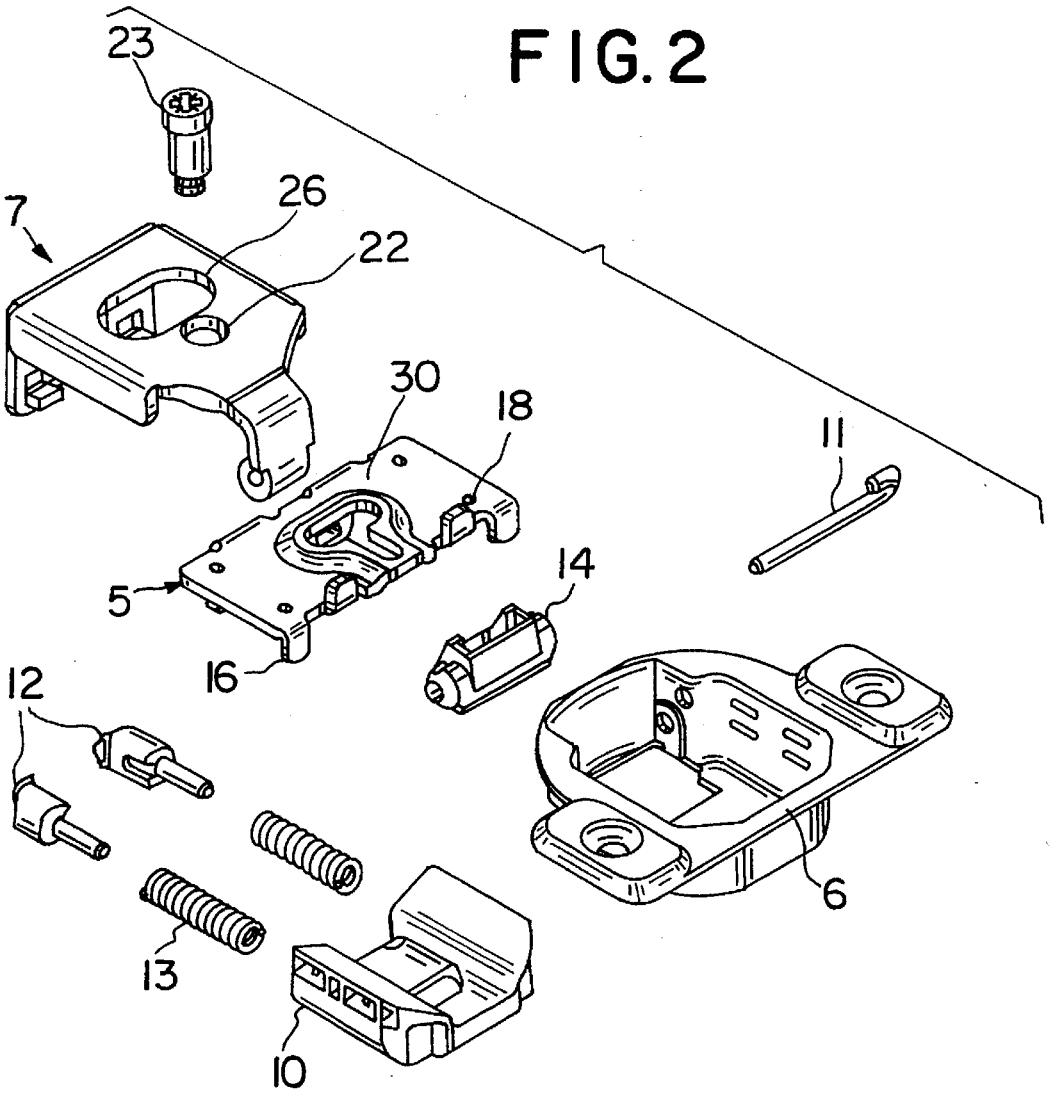
FIG. 3 is an exploded diagrammatic perspective view of the hinge.

In the drawings a door 1 is shown in an open position. A hinge 2 connects the door 1 to a frame 3 of a piece of furniture. Of the piece of furniture only parts of a side wall 4 thereon are shown.

The hinge 2 includes a hinge arm 7, a mounting plate 5 and a hinge casing 6 mounted to the door 1. The hinge arm 7 carries a hinge axle 11 by means of which the hinge casing 6 is connected to the hinge arm 7. The hinge casing 6 is inserted into a bore 8 in the door 1 and is fastened to the door 1 by means of screws 9.

At the base of the hinge casing 6 is provided a holding member 10, in which are held two pressure springs 13. Plugs 12 are inserted into the pressure springs 13. Plugs 12 act on a cam member 14 which is mounted on the free end of the hinge arm 7. By means of the pressure springs 13, the hinge casing 6 is held in its closed position or is moved into the closed position when the door 1 has not quite reached the closed position.

The mounting plate 5 is mounted directly on the frame 3 and is screwed to the frame 3 by means of a screw 15. The mounting plate 5 has on its side that faces the door 1 two flanges 16 which in mounted position abut the front side of frame 3. On its rear side the mounting plate 5 is also provided with flanges 17 which extend along the rear side of the frame 3. At its front edge the mounting plate 5 is provided with two protrusions 18 which project in a direction opposite to the direction of the flanges 16. These protrusions 18 provide abutments for the hinge arm 7.

Figure 4:
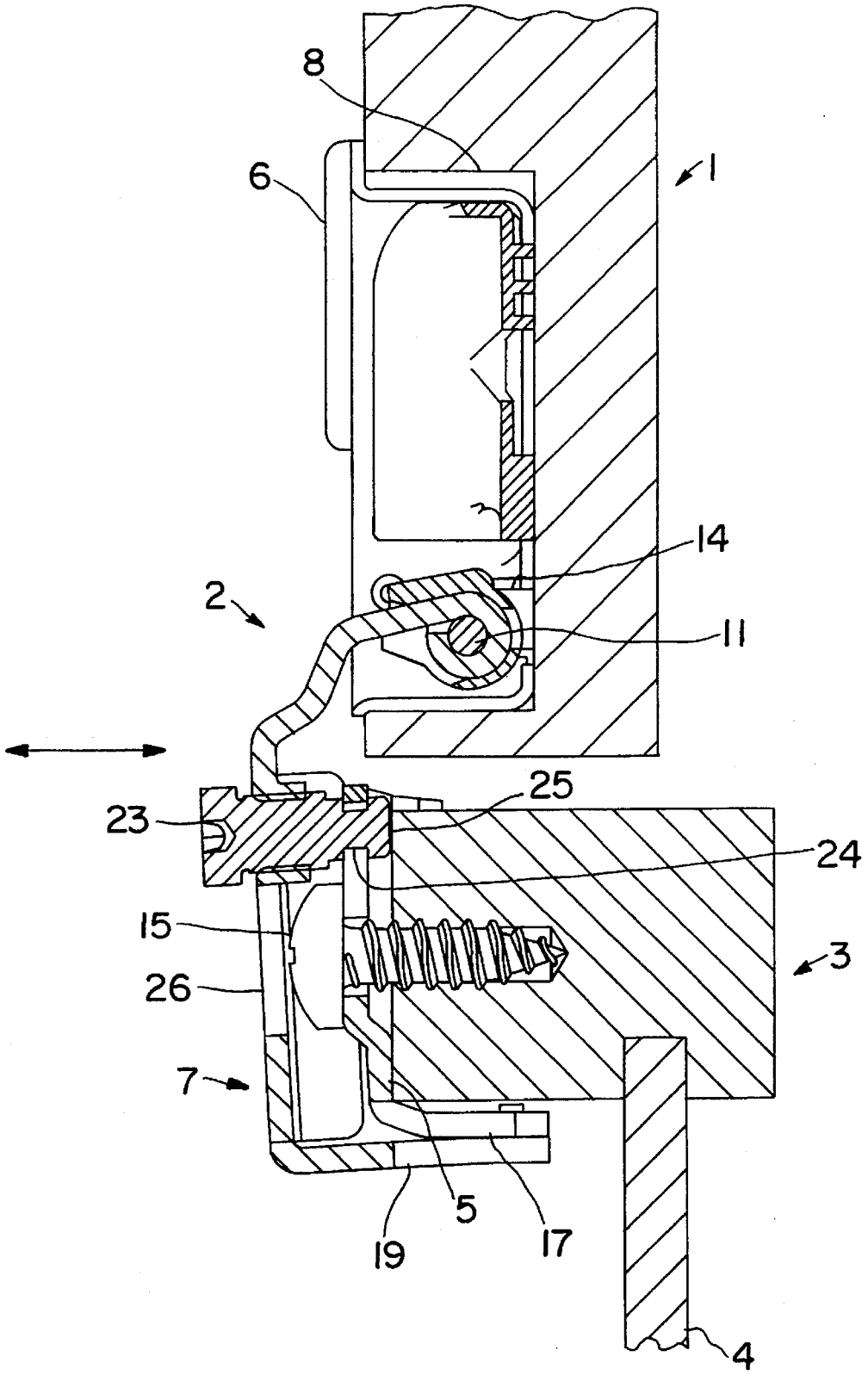
FIG. 4 is a horizontal sectional view of the hinge, parts of the door and the frame also being shown.
Figure 5:
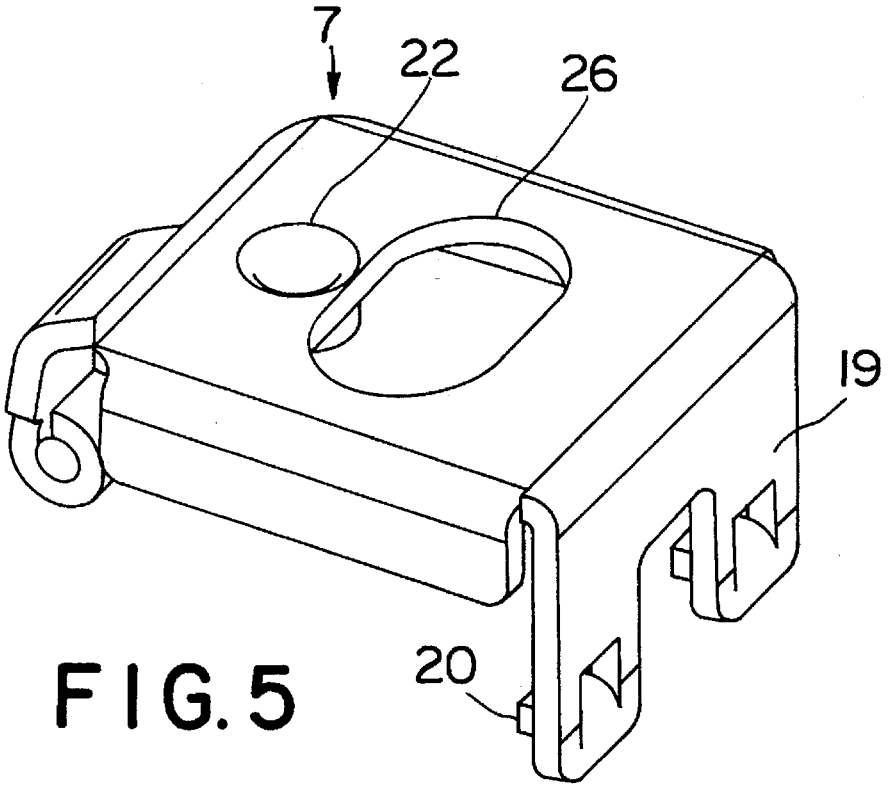
FIG. 5 is a diagrammatic perspective view of a hinge arm.
Figure 6:
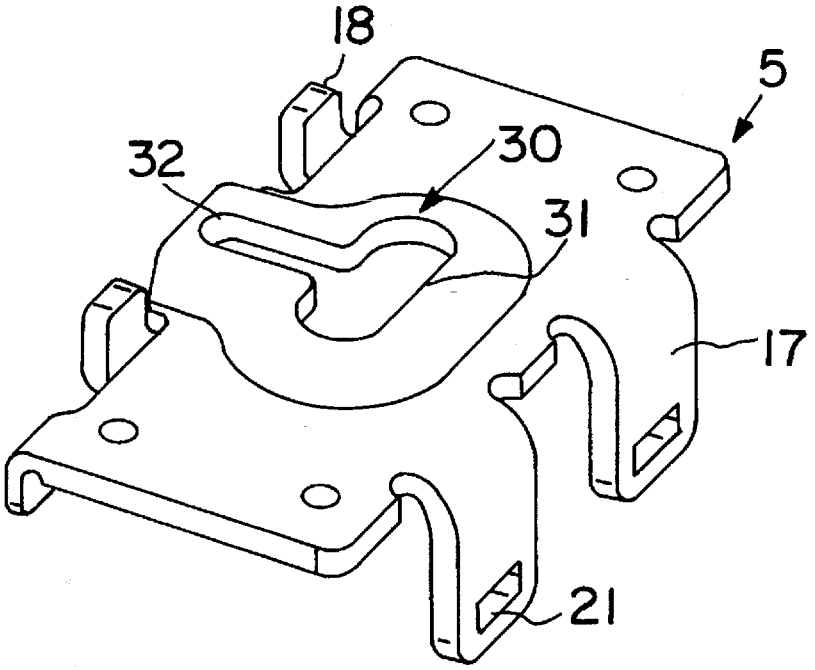
FIG. 6 is a perspective view of a mounting plate.
Figure 7:
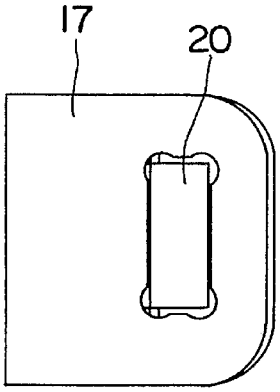
FIG. 7 is an end view of a flange.
Figure 8:
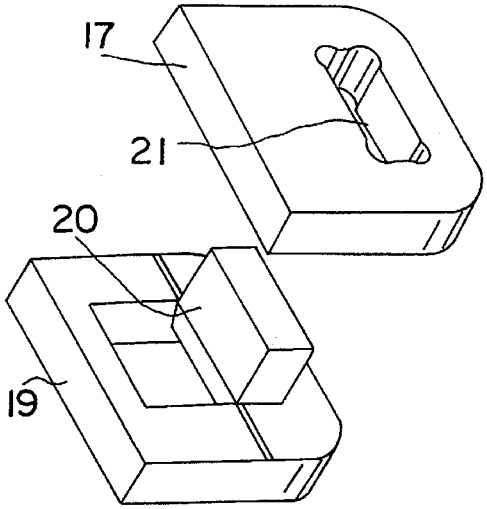
FIG. 8 is a perspective view of flanges of the mounting plate and the hinge arm.
Figure 9:
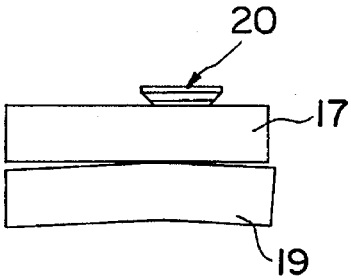
FIGS. 9 and 10 are side views of the flanges.
Figure 10:
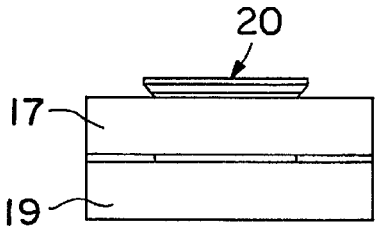

The rear end of hinge arm 7, that is its far end with respect to the hinge axle 11, is provided with two flanges 19 which in the assembled position of the hinge abut the flanges 17 of the mounting plate 5 (best seen in FIG. 4). Projections 20 are stamped out of the flanges 19 of the hinge arm 7 and protrude into slots 21 in the flanges 17 of the mounting plate 5. These projections 20 are advantageously riveted to the flanges 17 so that the hinge arm 7 is undetachably connected to the mounting plate 5. The hinge arm 7 at its sides is provided with flanges directed toward the mounting plate 5, thus providing the hinge arm 7 with a box or a case-like form.

The hinge arm 7 is provided with a threaded opening 22 with a female thread in which is held an adjustment screw 23 for adjustment of the door 1 in a direction of the arrow in FIG. 4. the adjustment screw 23 is provided with a threaded part, a head part 25 and a neck part 24. The mounting plate 5 is provided with a slot 30 having a T-shape including a broader part 31 and a narrow part 32. The broader part 31 extends parallel to the hinge axle 11 and the narrow part 32 extends perpendicular or orthogonal to the hinge axle 11. When mounting the hinge arm 7 on the mounting plate 5, the adjustment screw 23 which is held in the threaded opening 22 of the hinge arm 7 is pushed with its head part 25 through the broad part 31 of the slot 30 and is then moved with its neck part 24 into the narrow part 32 of the slot 30 so that the head part 25 of the adjustment screw 23 is held at the mounting plate 5. When mounting the hinge 2 on the frame 3, the fastening screw 15 is screwed into the frame 3 and protrudes through the part 31 of the slot 30. The hinge arm 7 is provided with an elongated slot 26 which allows insertion of the fastening screw 15 into the slot 30 of the mounting plate 5.

The elongated broader part 31 of the slot 30 makes it possible to adjust the position of the mounting plate 5 and therefore of the hinge arm 7 in the direction of the height of the piece of furniture. By turning the adjustment screw 23, the hinge arm 7 is pivoted about an axis defined by the projections 20. By this pivoting of the hinge arm 7, an adjustment of the position of the hinge axle 11 in the direction shown by the double arrow of FIG. 4 is possible. In this way the position of the closed door 1 can be adjusted with respect to both sides of the frame 3 and the piece of furniture.

We claim:

1. A hinge for mounting a door on a frame of an article of furniture, said hinge comprising:

a mounting plate mountable on the frame, said mounting plate having therein a T-shaped hole including a broad first part and a narrow second part;

a hinge case mountable on the door;

a hinge arm connected to said hinge case by at least one hinge axle and mounted on said mounting plate, said hinge arm having therein a threaded opening;

an adjustment screw having a threaded part, a head part and a neck part, said neck part having a diameter smaller than a diameter of said threaded part;

said broad first part of said T-shaped hole having a width greater than a diameter of said head part of said adjustment screw, and said narrow second part of said T-shaped hole having a width less than said diameter of said head part and said diameter of said threaded part of said adjustment screw;

said threaded part of said adjustment screw being threaded into said threaded opening of said hinge arm, with said neck part of said adjustment screw being held in said narrow second part of said T-shaped hole, and with said head part of said adjustment screw abutting a rear side of said mounting plate opposite said hinge arm; and said mounting plate including at least one flange injecting from said mounting plate in a direction away from said hinge arm, said hinge arm including at least one flange extending in said direction and abutting said flange of said mounting plate, and said flanges of said mounting plate and said hinge arm being connected by connection structure, such that threaded adjustment of said threaded part of said adjustment screw in said threaded opening of said hinge arm results in tilting of said hinge arm relative to said mounting plate about said connection structure.

2. A hinge as claimed in claim 1, wherein said mounting plate is mountable on the frame by at least one fastening screw.

3. A hinge as claimed in claim 2, wherein said fastening screw extends through said broad first part of said T-shaped hole.

4. A hinge as claimed in claim 1, wherein said narrow second part of said T-shaped hole extends orthogonal to said hinge axle.

5. A hinge as claimed in claim 1, wherein said connection structure comprises a projection of said flange of said hinge arm projecting into a slot in said flange of said mounting plate.

6. A hinge as claimed in claim 5, wherein said projection is riveted to said flange of said mounting plate.

7. A hinge as claimed in claim 1, wherein said mounting plate and said hinge arm each have two respective said flanges.

8. A hinge as claimed in claim 1, wherein said hinge arm has therein a slot that extends parallel to said hinge axle.

9. A hinge as claimed in claim 8, wherein said slot provides access to a fastening screw to mount said mounting plate to the frame.

10. A hinge as claimed in claim 9, wherein said fastening screw extends through said broad first part of said T-shaped hole.

11. A hinge as claimed in claim 1, wherein said hinge arm has at opposite sides thereof flanges directed toward said mounting plate.

12. A hinge as claimed in claim 11, wherein said mounting plate has extending from opposite sides thereof respective flanges projecting from said mounting plate in a direction away from said hinge arm, said flanges being operable to extend along opposite sides of the frame.

13. A hinge as claimed in claim 1, wherein said mounting plate has at a first side thereof at least one projection projecting in a direction toward said hinge arm and defining an abutment for said hinge arm.

* * * * *